US006386937B1

(12) United States Patent
Cappello et al.

(10) Patent No.: US 6,386,937 B1
(45) Date of Patent: May 14, 2002

(54) MAGNETICALLY COUPLED TOY APPARATUS

(75) Inventors: Ray J. Cappello, Orchard Park, NY (US); Rouben T. Terzian, Chicago, IL (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/411,003

(22) Filed: Oct. 1, 1999

(51) Int. Cl.[7] ..... A63H 33/26

(52) U.S. Cl. ..... 446/139; 446/136; 446/137; 446/138; 446/330; 446/395; 434/393

(58) Field of Search ..... 446/139, 136, 446/129, 131, 133, 135, 137, 138, 298, 301, 304, 330, 331, 395; 434/168, 330, 393

(56) References Cited

U.S. PATENT DOCUMENTS

| | | | | |
|---|---|---|---|---|
| 1,777,908 A | | 4/1916 | Teeters | |
| 2,213,901 A | | 9/1940 | Crawford | 46/45 |
| 2,519,884 A | | 8/1950 | Bustanoby | 46/45 |
| 3,229,421 A | * | 1/1966 | Ostrander | |
| 3,266,187 A | | 8/1966 | Felsher | 46/239 |
| 3,394,494 A | * | 7/1968 | Gardel et al. | |
| 3,867,786 A | | 2/1975 | Greenblatt | 46/236 |
| 3,918,199 A | | 11/1975 | De Masi | 46/247 |
| 4,132,032 A | | 1/1979 | Triska | 46/237 |
| 4,159,594 A | * | 7/1979 | Reiner et al. | |
| 4,249,337 A | | 2/1981 | Edson | 46/153 |
| 4,708,685 A | | 11/1987 | Udagawa | 446/139 |
| 5,092,811 A | * | 3/1992 | Bergenguer | 446/301 |
| 5,190,492 A | | 3/1993 | Berenguer | 446/301 |
| 5,362,271 A | | 11/1994 | Butt | 446/139 |
| RE36,776 E | * | 7/2000 | Jurmain et al. | 434/238 |

FOREIGN PATENT DOCUMENTS

| | | | | |
|---|---|---|---|---|
| CA | 496039 | | 9/1953 | |
| DK | 75299 | | 1/1953 | |
| GB | 2 077 117 A | | 12/1981 | |
| GB | 2 177 611 A | | 1/1987 | |
| GB | 2279885 A | * | 1/1995 | 446/304 |
| RU | 1583125 | | 7/1990 | |

* cited by examiner

*Primary Examiner*—Jacob K. Ackun, Jr.
*Assistant Examiner*—Bena B. Mills
(74) *Attorney, Agent, or Firm*—Morgan, Lewis & Bockius

(57) ABSTRACT

A magnetically coupled toy system having two toy components such as a doll and nursing bottle is shown. The nursing bottle contains a motor-driven rotating permanent magnet in the nipple portion. A second permanent magnet is mounted in a flexible region around the mouth of a doll. When the nipple containing the rotating magnet is placed in proximity with the mouth of the doll, relative motion between the magnets imparts motion to the mouth and lip regions of the doll.

8 Claims, 12 Drawing Sheets

MAGNETICALLY COUPLED TOY APPARATUS

BACKGROUND OF THE INVENTION

1. Field of the Invention

The present invention relates to an apparatus for generating lifelike motion in a toy, and more particularly, for simulating facial motion in dolls and animal characters. While the present invention has many applications, it is particularly suited for simulating a lip sucking action in a nursing doll, animal, or other character.

2. Description of the Related Art

There are a variety of known mechanisms for generating motion in the lips of dolls. For example, U.S. Pat. No. 5,190,492 to Berenguer discloses a doll that simulates a sucking action through the mechanical coupling of an eccentric shaft with the face of the doll. The device of Berenguer is activated when a nipple containing a magnetic element is placed in the mouth of the doll, triggering a magnetic field detector in the doll, and thereby starting a motor mounted in the doll body.

Another example of a mechanism that simulates a sucking motion in a doll is disclosed in U.S. Pat. No. 3,918,199 to De Masi. The device of De Masi produces a simulated sucking motion through the mechanical coupling of a geared motor unit contained within the doll body.

Known doll lip articulation devices rely on elaborate and higher cost mechanical drive mechanisms housed within the doll. The placement of a motor in the doll results in additional complexity in the fabrication process because each doll must be equipped with a complex internal drive mechanism and power source. Consequently, a need exists for a low-cost doll lip articulation mechanism that can be housed in a doll accessory, such as a nursing bottle, and can be used interchangeably with all of the dolls or characters in a particular product line. Additionally, a need exists for a doll lip articulation device in which the active drive mechanism and power source may be located outside the body of the doll and only less expensive passive components are located within the body of the doll.

SUMMARY OF THE INVENTION

The present invention has been made in view of the above circumstances and has as an object reducing the cost and complexity of a toy motion-generating device by locating the active components of the drive mechanism in a portable self-contained toy accessory, such as a nursing bottle.

A second object of the invention is to improve facial movement simulation in dolls and animal characters so as to stimulate child learning and development, while enhancing a child's play experience.

Additional objects and advantages of the invention will be set forth in part in the description that follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a toy system with a first toy component having a first magnet mounted to the first toy component for movement relative to the first toy component, and a driving mechanism for imparting motion to the first magnet. A second toy component of the toy system has a receptor portion and a second magnet mounted near the receptor portion. The receptor portion is adapted to interact with the first toy component and move in synchronization with motion imparted to the second magnet through magnetic coupling with the first magnet.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in, and constitute a part of this specification, illustrate a presently preferred embodiment of the invention and, together with the description, serve to explain the operation of the invention.

In the drawings.

DESCRIPTION OF THE PREFERRED EMBODIMENT

Figure 1:
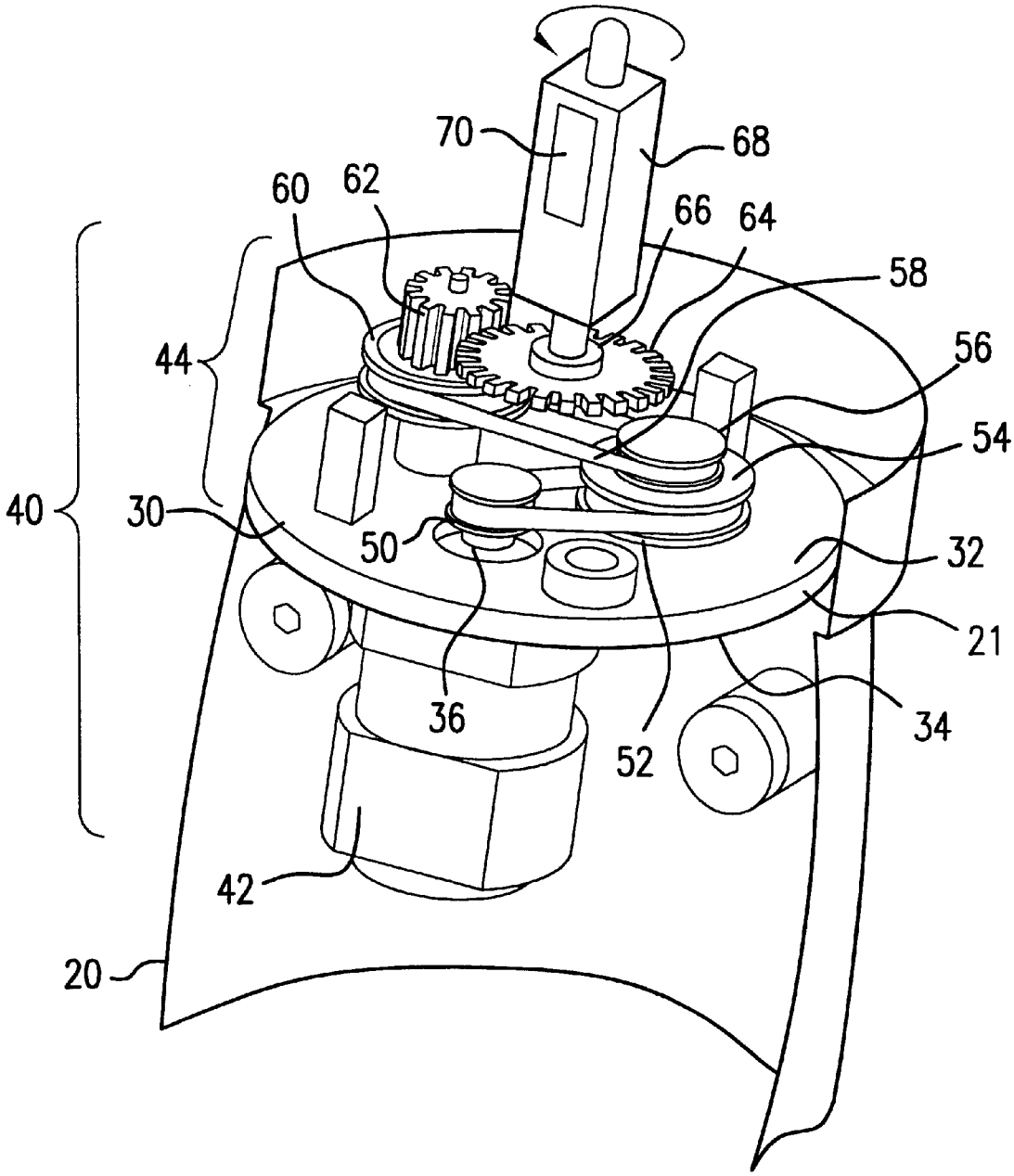
FIG. 1 is a partial cross sectional view of an embodiment of the drive mechanism in accordance with the present invention.
Figure 2A:
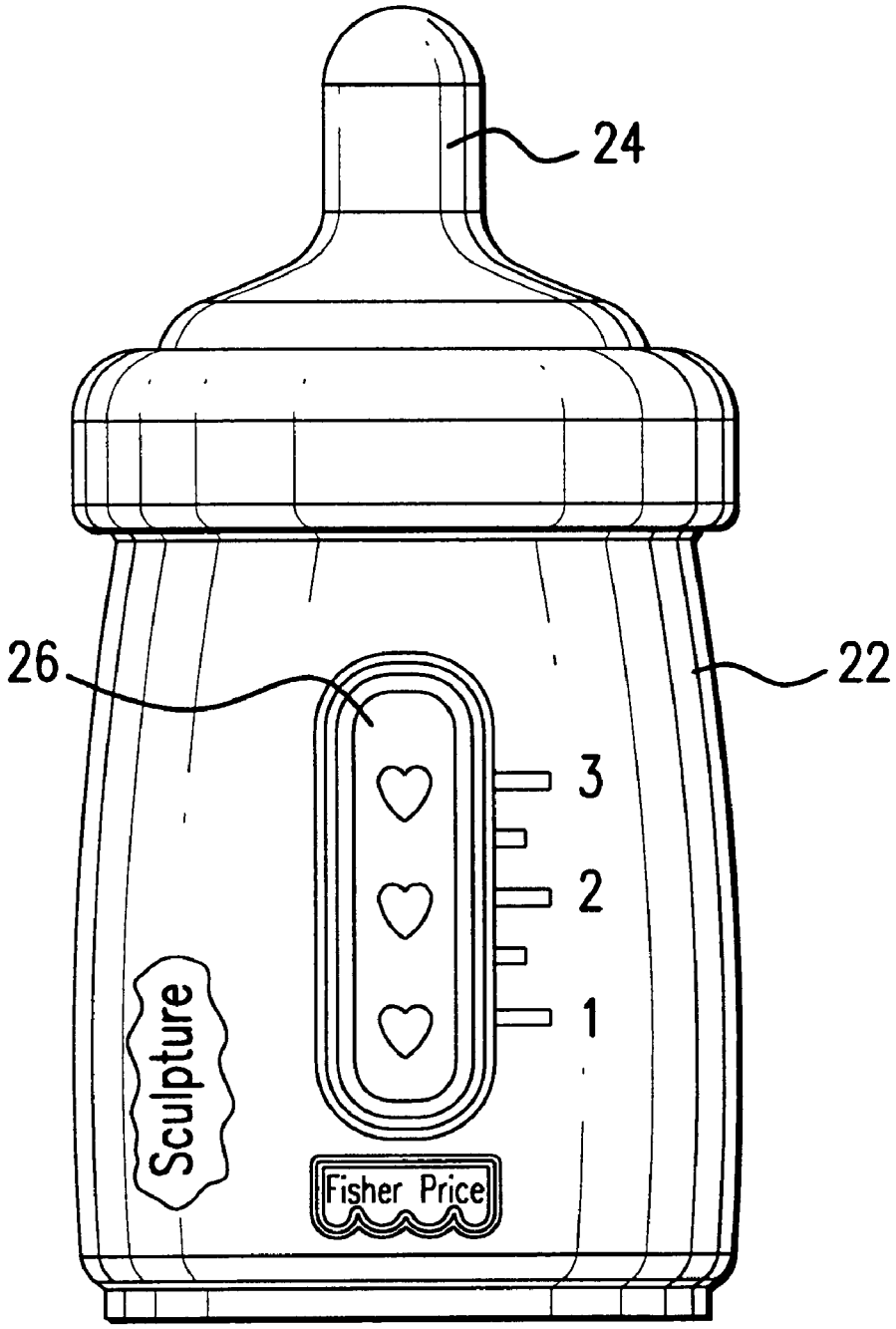
FIG. 2*a* is a front view of the bottle housing.
Figure 2B:
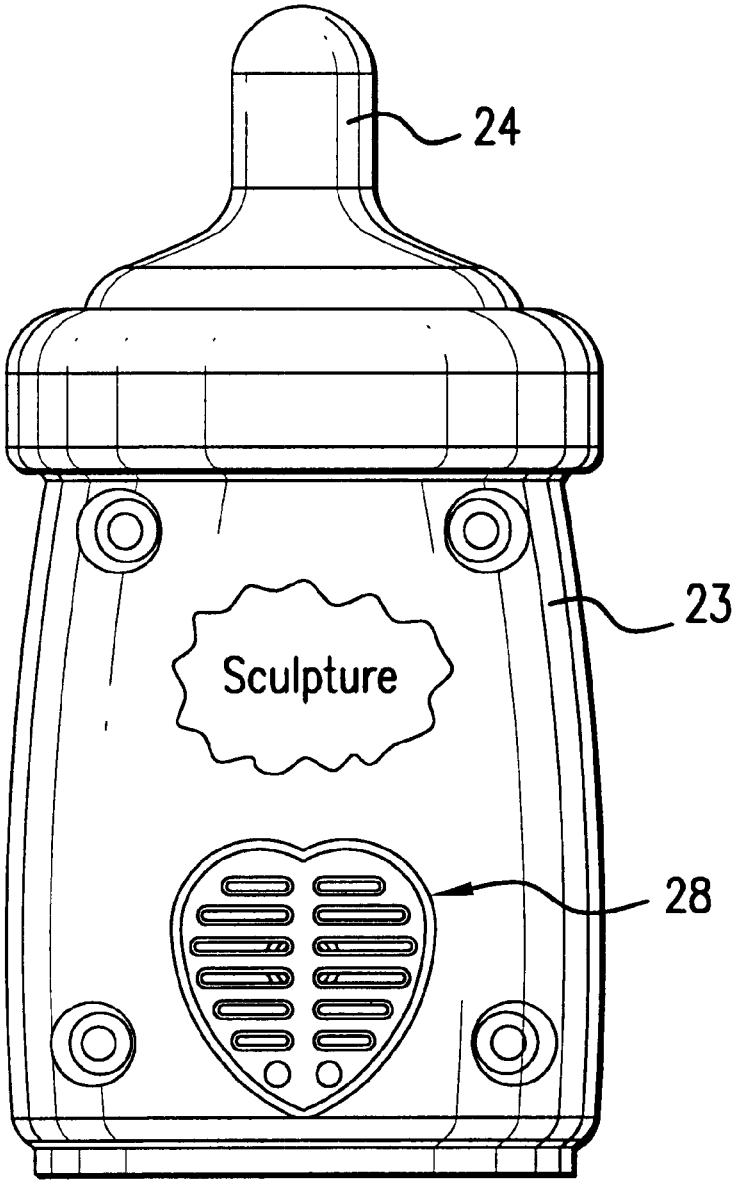
FIG. 2*b* is a rear view of the bottle housing.
Figure 2C:
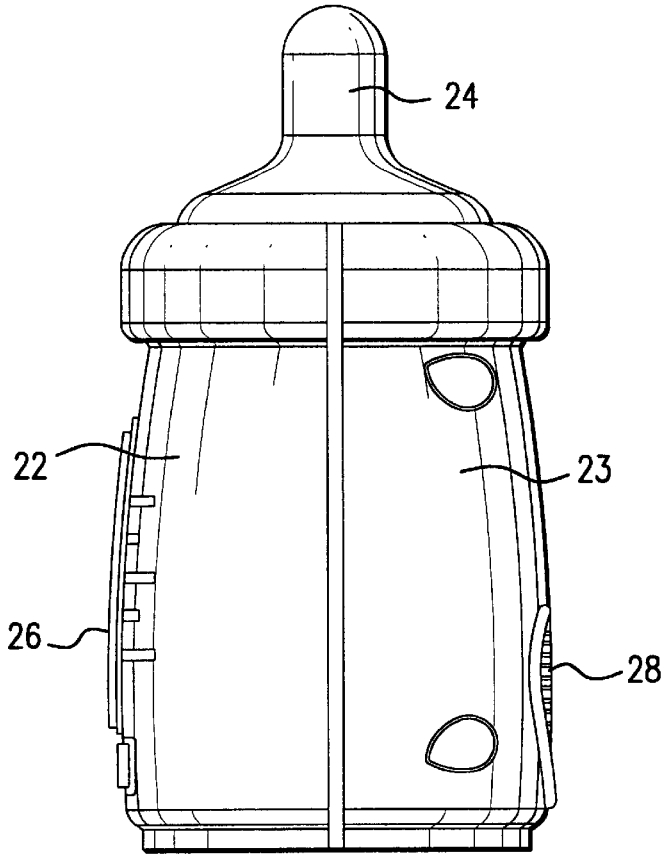
FIG. 2*c* is a side view of the bottle housing.
Figure 2D:
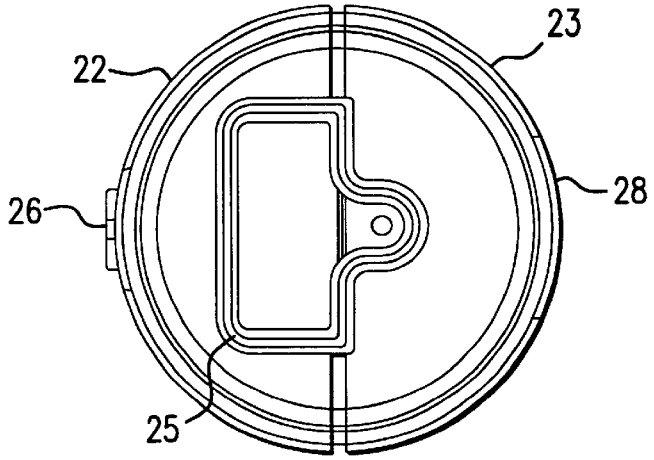
FIG. 2*d* is a bottom view of the bottle housing.
Figure 2E:
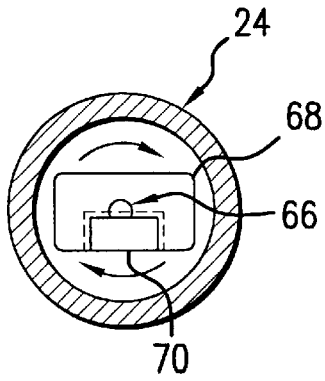
FIG. 2*e* is a cross sectional view of the nipple of the bottle.
Figure 2F:
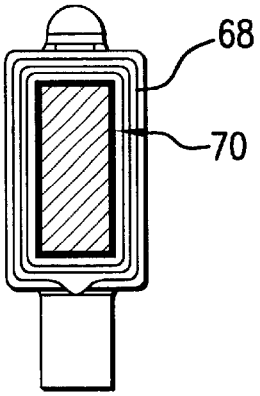
FIG. 2*f* is a cross sectional view of the magnet holder and magnet.
Figure 2G:
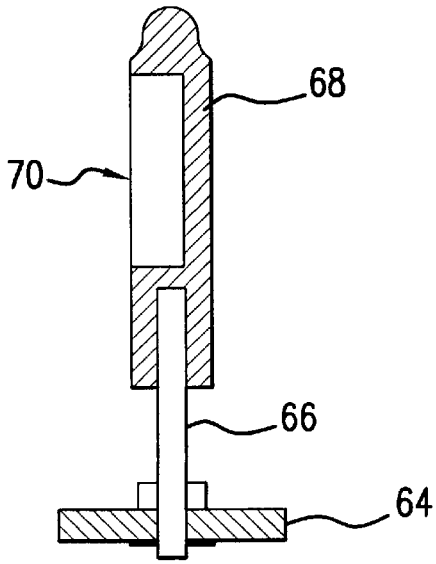
FIG. 2*g* is a cross sectional view of the magnet holder, magnet, and drive shaft.
Figure 3:
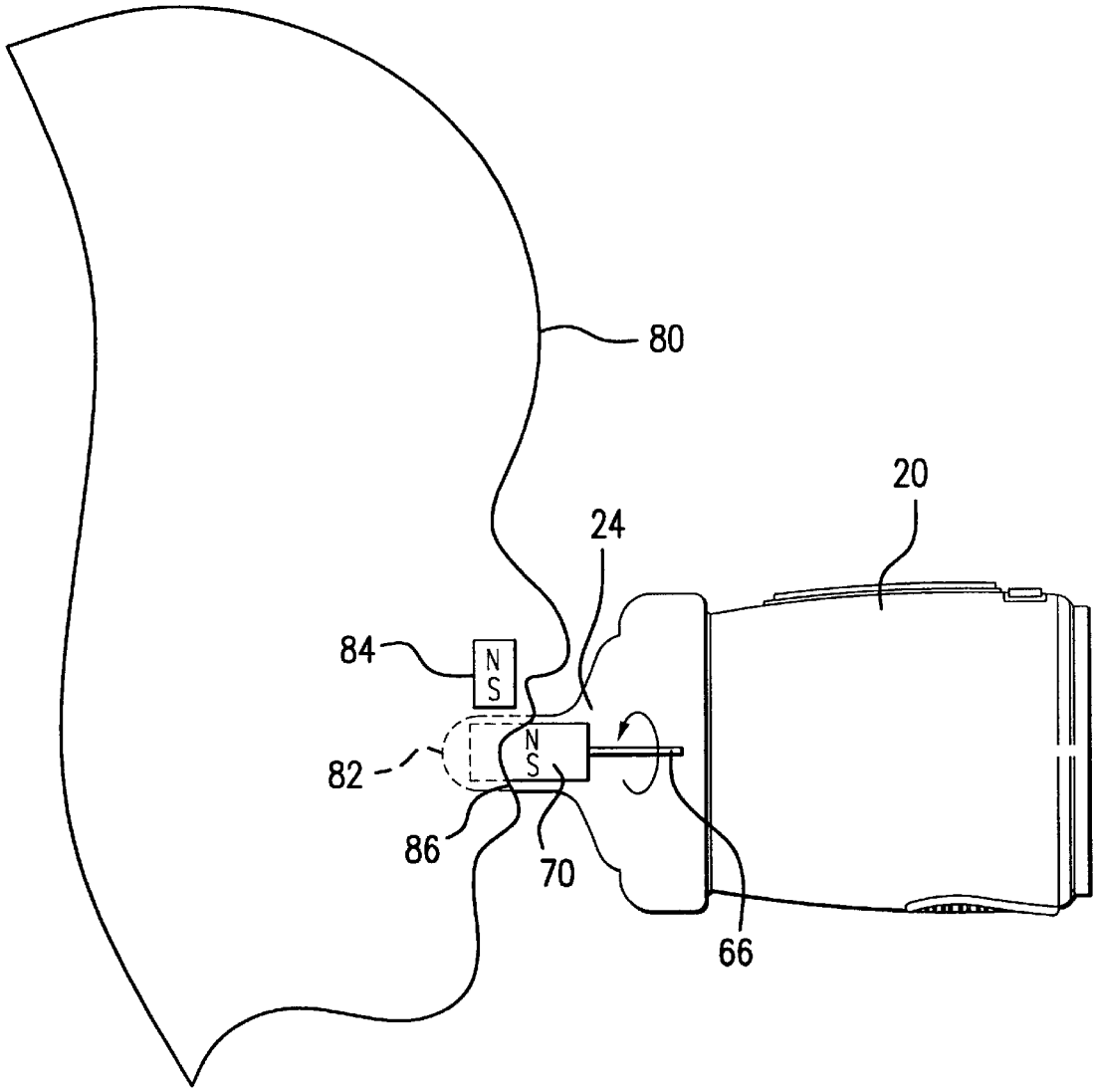
FIG. 3 illustrates a physical embodiment of the toy system in operation.

A preferred embodiment of a doll and nursing bottle toy system incorporating the principles of the invention is shown in FIGS. 1–3. A functional description of the invention is presented first, followed by a description of a preferred physical embodiment. Wherever possible, the same reference numbers will be used throughout the drawings to refer to the same or like parts.

The invention includes a first toy having a first magnet and a driving mechanism for imparting motion to the first magnet; and a second toy having a flexible region and a second magnet affixed within the flexible region. In operation, when the user places the first toy and magnet in proximity with the second toy and magnet, the movement of the first magnet causes the second magnet and the flexible region of the second toy to move through magnetic coupling.

The invention will be further clarified by the following detailed description of a presently preferred physical embodiment of the invention.

FIG. 1 discloses the principal features of a toy nursing bottle embodying the present invention. The nursing bottle 20 comprises a plastic housing molded to simulate the shape of an infant's bottle. Within the bottle 20, a circular mounting plate 30 having an upper planar surface 32 and a lower planar surface 34 is supported by a circumferential shelf 21 molded into the plastic housing 20. The mounting plate 30 supports a driving portion 40 comprising a motor 42 mounted on the lower planar surface 34 and reduction train 44 mounted on the upper planar surface 32.

The drive shaft (not shown) of the motor 42 extends through a hole 36 in the mounting plate 30 and terminates in a pulley wheel 50 that couples with the input pulley 54 of the reduction train 44 via a first drive belt 52. A reduction train output shaft 66 extends from the output gear 64 of the reduction train 44. A magnet holder 68 is affixed over the end of the output shaft 66. A permanent magnet 70 is affixed to the magnet holder such that the axis formed by the poles of the permanent magnet 70 forms a non-zero angle with respect to the rotational axis of the output shaft 66. In the preferred embodiment, the permanent magnet 70 forms a right angle with respect to the rotational axis of the output shaft 66. In the preferred embodiment, the permanent magnet 70 rotates at approximately 260 RPM to generate a lifelike appearance.

As best illustrated in FIGS. 2*a–d*, the molded plastic bottle housing 20 comprises a front half 22 and a back half 23 joined by fasteners such as screws, snap fittings, etc. (not shown); a nipple portion 24 covering the top of the bottle; and a battery compartment lid 25 that provides access to a battery compartment (not shown) within the bottle.

Any suitable electric motor or drive mechanism can be used. A suitable motor is model FA-130-14150 commercially available from Mabuchi. However, as will be appreciated by one skilled in the art, any off-the-shelf toy motor having similar characteristics may be substituted including any conventional wind-up spring motor.

In the preferred embodiment, power is supplied to the motor by two "AA" batteries housed within the battery compartment and connected to the motor via an activation button 26 mounted in the front half of the bottle housing 22.

In the preferred embodiment, power is transmitted from the motor 42 to the output shaft 66 via a suitable reduction train consisting of a pulley wheel 50 having an effective diameter of about 0.17" (0.43 cm) mounted on the end of the motor output shaft and coupled via a neoprene drive belt 52 to a large diameter pulley 54 having an effective diameter of about 0.5" (1.3 cm) wherein the large diameter pulley 54 is coaxially coupled with a small diameter pulley 56 having an effective diameter of about 0.17" (0.43 cm); the small diameter pulley 56 is in turn coupled via a second neoprene drive belt 58 to a second large diameter pulley 60 having an effective diameter of about 0.5" (1.3 cm), wherein the second large diameter pulley 60 is coaxially coupled with a first gear 62 having a pitch diameter of about 0.25" (0.65 cm); finally, the first gear 62 engages the output gear 64 having a pitch diameter of about 0.63" (1.6 cm).

As will be appreciated by one skilled in the art, any reduction train having similar characteristics may be substituted for the reduction train described above. In an alternative embodiment, the permanent magnet 70 may be driven directly from the output shaft of the motor 42. It will also be recognized that the dimensions of the gears, pulleys and belts can be varied depending on the size of the toy and desired rate of movement.

An audio signal generator (not shown) includes a speaker (not shown), mounted in the bottle housing 20 behind a speaker grill 28. As an example, the speaker can be 1" (2.5 cm) diameter or other suitable sizes with a range of sound outputs and located in various positions on the bottle.

The audio signal generator can be implemented using a sound effects generating IC as is well known in the art. The audio content can be stored in digital form in the memory of the IC or provided on removable media. The audio content can include any desired sounds such as music, vocal sounds, sounds of a baby nursing, sounds of food being eaten, animal sounds, etc.

FIG. 3 illustrates the principal features of a doll face 80 in accordance with a presently preferred embodiment of the invention. As used herein, the term "doll" includes any toy resembling a human, animal or fantasy character. The doll face 80 has a flexible mouth region 82 formed of elastomeric materials or other materials having similar flexible qualities. A second permanent magnet 84 is mounted in the flexible mouth region 85 in proximity to the lip region 86. A suitable magnet can be about 1.5 mm×6.0 mm×20.0 mm in size. The magnet can be sewn into the mouth region or otherwise mounted.

Figure 5A:
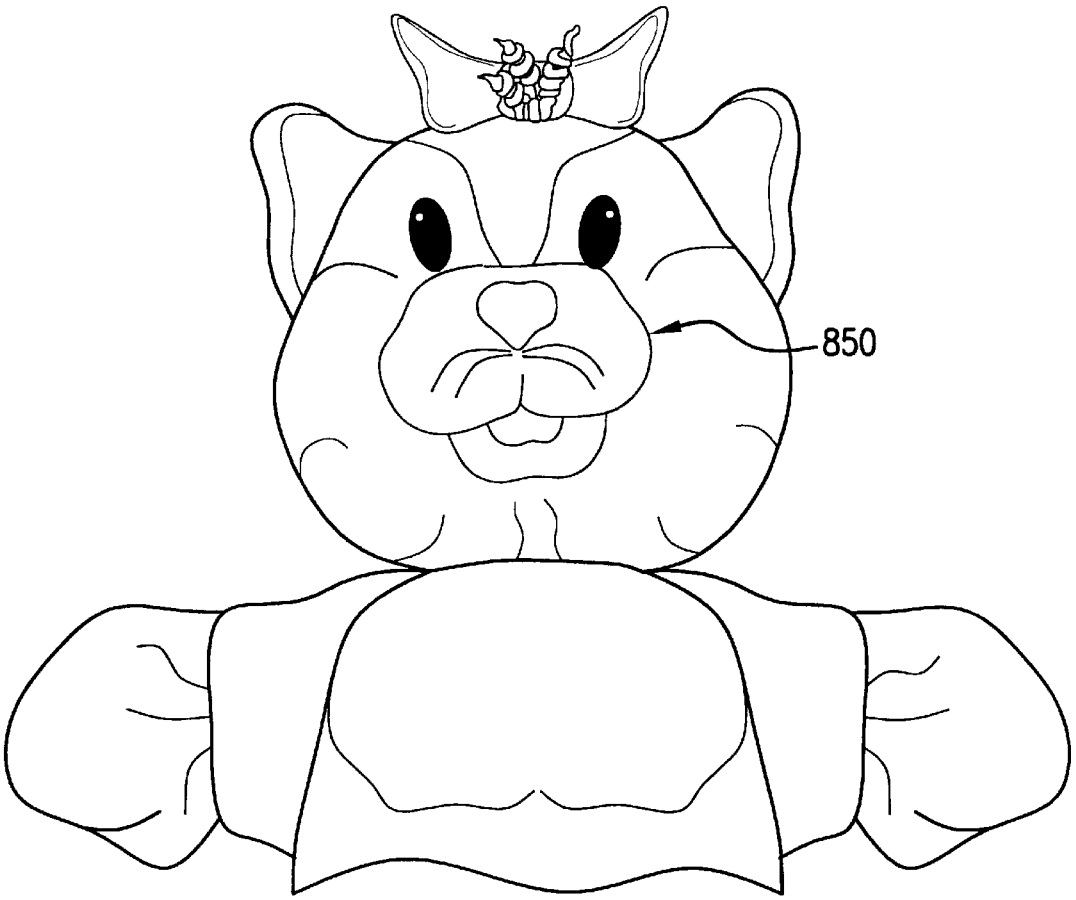
FIG. 5*a* illustrates a character toy in accordance with a second alternative embodiment of the present invention.
Figure 5B:
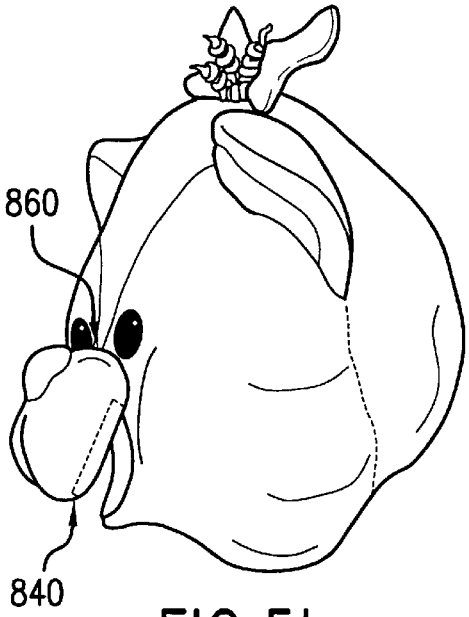
FIG. 5*b* illustrates a side view of a character toy in accordance with a second alternative embodiment of the present invention.
Figure 5C:
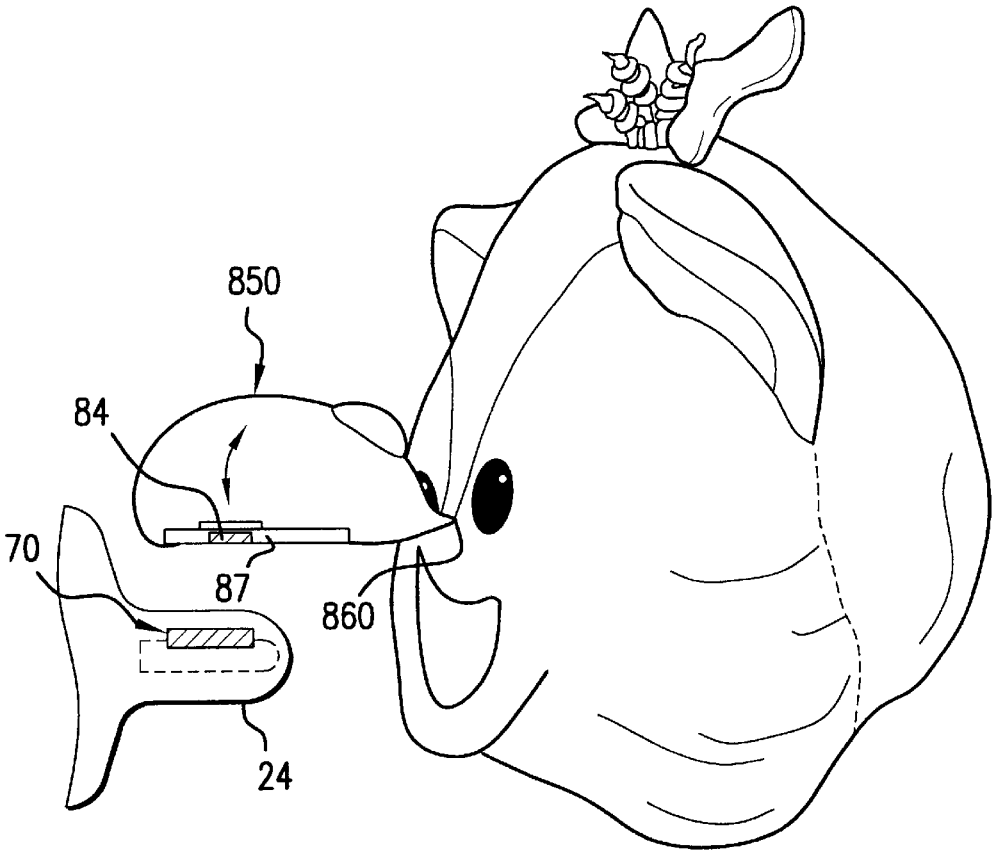
FIG. 5*c* illustrates a physical embodiment of the toy system in operation in accordance with a second alternative embodiment of the present invention.
Figure 5D:
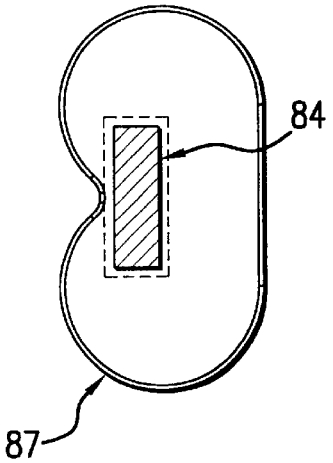
FIG. 5*d* illustrates a mouth plate and magnet in accordance with the present invention.
Figure 5E:
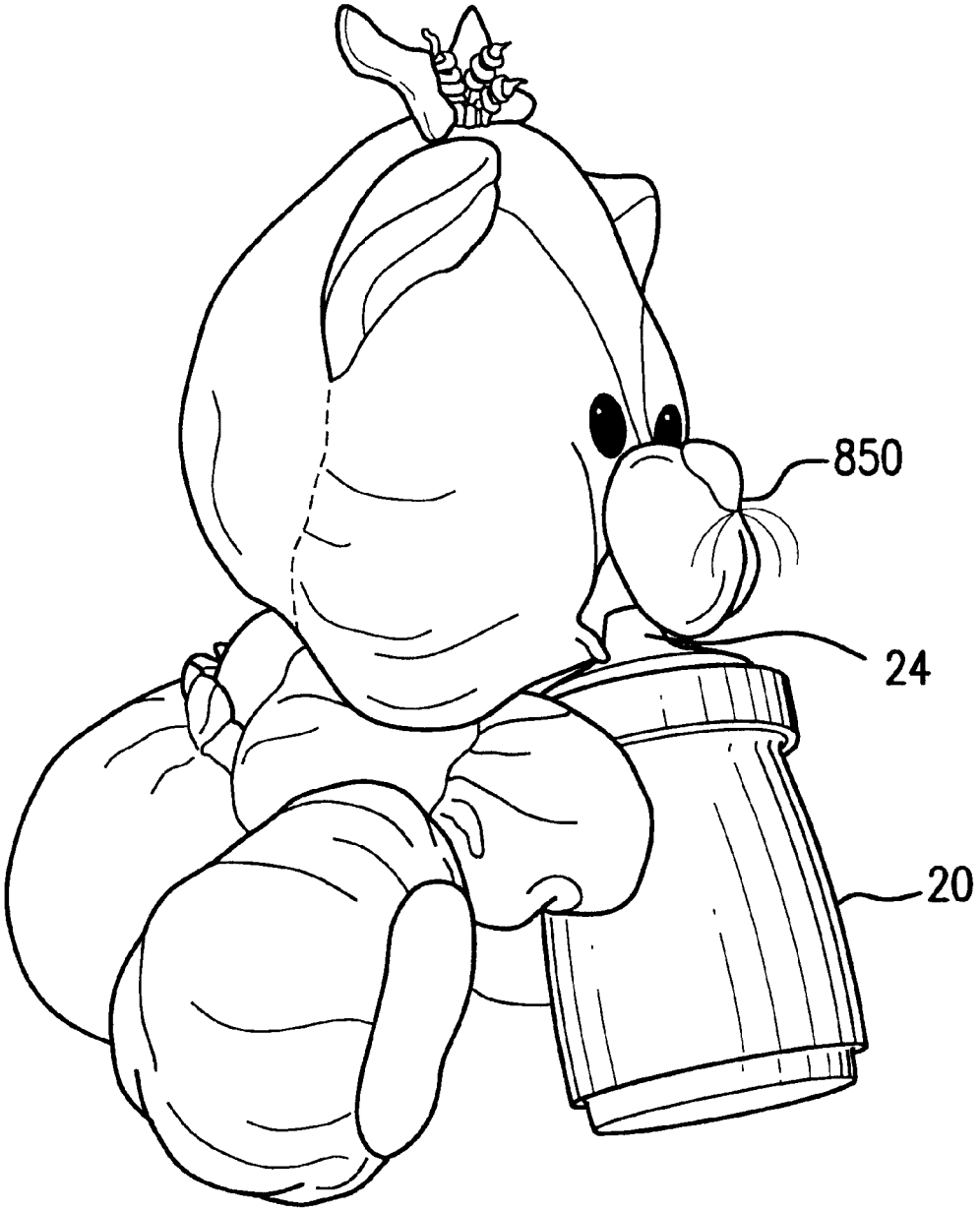
FIG. 5*e* illustrates a toy character in accordance with a second alternative embodiment of the present invention.

FIG. 5*d* illustrates a device for mounting the permanent magnet 84 according to an alternative embodiment of the present invention using a plastic mouth plate 87 for mounting a magnet 84. In this embodiment, the mouth plate is sewn into the doll's mouth or hinged upper lip.

The doll operates by placing the nipple 24 of the bottle 20 in close proximity to the mouth region of the doll while depressing the activation button 26 on the bottle housing 22. Depressing the activation button 26 causes the motor 42 to rotate the permanent magnet 70 within the nipple 24 of the bottle. The rotating permanent magnet 70 imparts motion to the second permanent magnet 84. The interaction of the magnets, as poles of the magnets pass near each other, generates corresponding movement in the flexible lip region 82 of the doll and the doll appears to be sucking on the nipple of the bottle. The cyclic attraction and repulsion of the magnets can be supplemented by the action of gravity on the lip region of the doll. Depressing the activation button 26 also serves to activate the audio signal generator causing appropriate sound effects or musical tunes to be played.

Figure 4A:
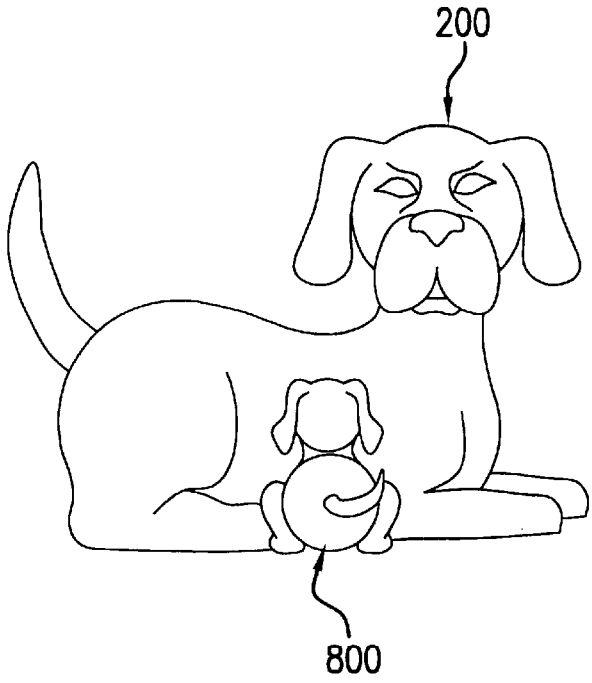
FIG. 4*a* illustrates a physical embodiment of the toy system in operation in accordance with a first alternative embodiment of the present invention.
Figure 4B:
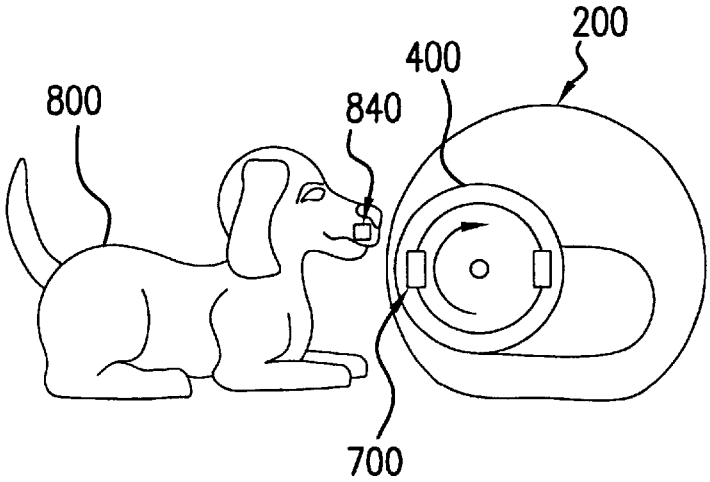
FIG. 4*b* is a partial sectional view illustrating a physical embodiment of the toy system in operation in accordance with a first alternative embodiment of the present invention.

Application of the invention disclosed herein is not limited to the doll and bottle combination described heretofore. For example, FIGS. 4*a* and 4*b* illustrate a first alternative embodiment in accordance with the present invention wherein the drive mechanism and rotating magnet described above are housed within the body of a mother toy animal 200, such as, for example, a dog, cat, or cow. In this embodiment, the second magnet 840 is placed in the flexible mouth or muzzle region of an infant animal or character doll. In like manner to the bottle and doll combination described above, a motorized magnet 700 in the mother doll 200 creates the appearance of the infant doll nursing from the mother doll. This embodiment may be used, for example, to create the appearance of puppies, kittens or farm animals nursing from their mother.

FIGS. 5*a–e* illustrate a second alternative embodiment in accordance with the present invention wherein the drive mechanism and rotating magnet described above are housed within the body of a toy such as a bottle, as described above in the description of the preferred embodiment. However, in the second alternative embodiment, the second magnet 840 is placed in or on a hinged flap-like region 850 forming the upper lip area of a toy character. The magnet may be sewn into the flap-like region 850 using the mouth plate 87 as shown in FIG. 5*d*. The hinge 860 may be formed from cloth or any other suitable material including plastic or metal. In like manner to the bottle and doll combination described above, a motorized magnet 70 in a bottle nipple 24 or other desired toy component causes the hinged flap-like region 850 to move, thereby creating the appearance that the character doll is nursing, eating, etc.

Figure 6A:
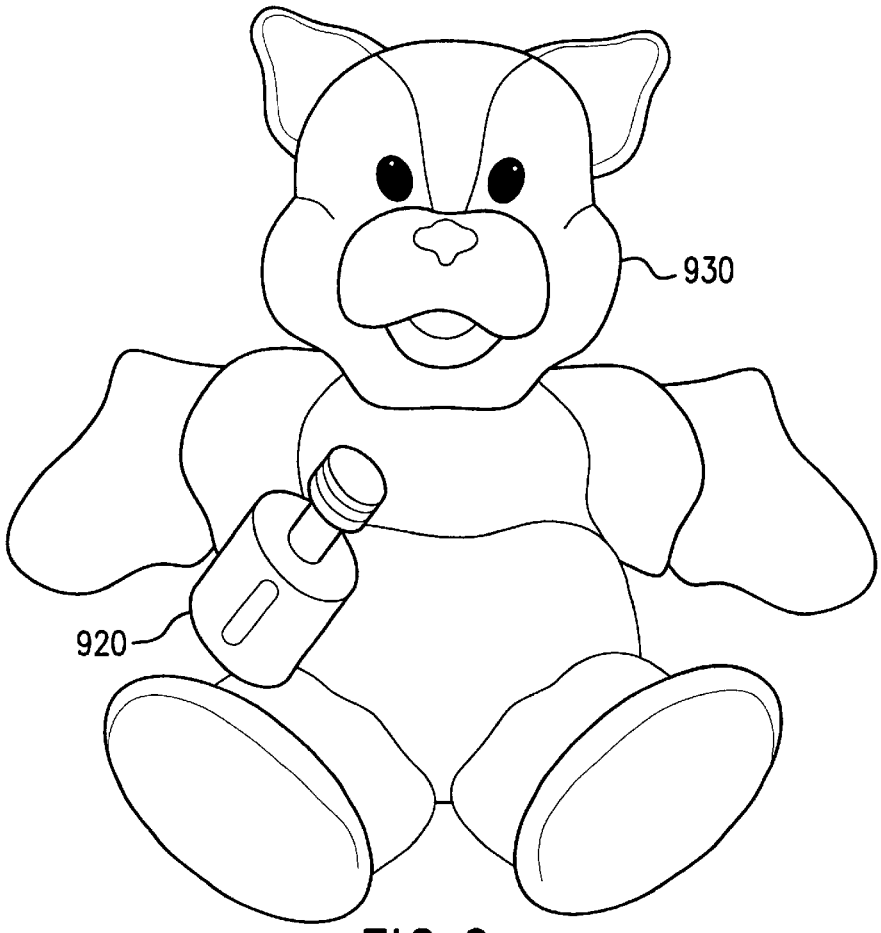
FIG. 6*a* illustrates a physical embodiment of the toy system in operation in accordance with a third alternative embodiment of the present invention.
Figure 6B:
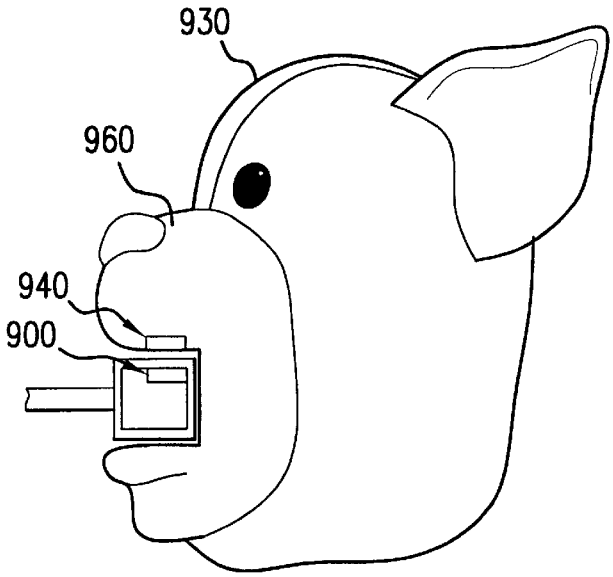
FIG. 6*b* further illustrates a physical embodiment of the toy system in operation in accordance with a third alternative embodiment of the present invention.

FIGS. 6*a–b* illustrate a third alternative embodiment in accordance with the present invention wherein the drive mechanism and rotating magnet described above are housed within a toy eating or other kitchen utensil, such as a honey dipper. When the toy utensil 930 containing a rotating magnet 900 is placed in or near the mouth of a doll or animal character 930 containing a magnet 940 capable of movement within a flexible region of the mouth 960, the magnets alternately repel and attract each other creating the appearance that the doll is feeding from the utensil.

Figure 7A:
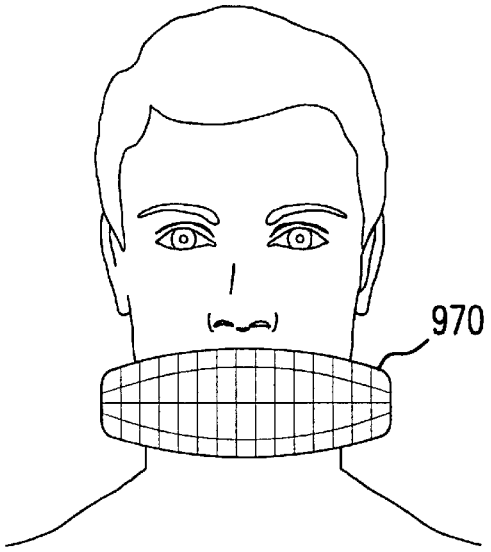
FIG. 7*a* illustrates a physical embodiment of the toy system in operation in accordance with a fourth alternative embodiment of the present invention.
Figure 7B:
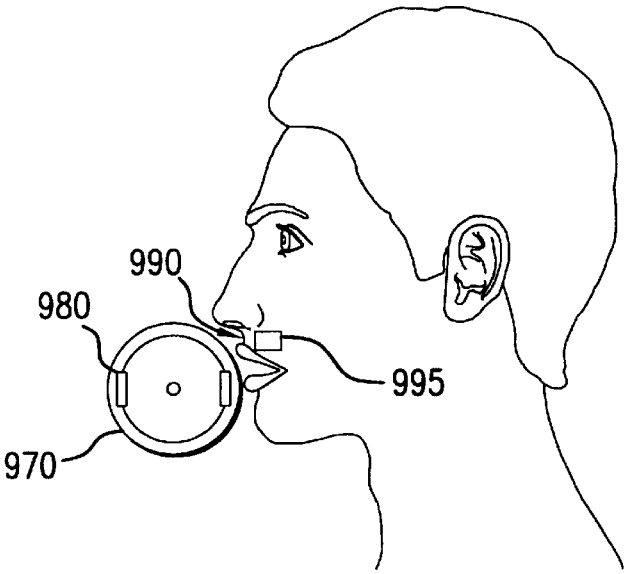
FIG. 7*b* further illustrates a physical embodiment of the toy system in operation in accordance with a fourth alternative embodiment of the present invention.

FIGS. 7*a–b* illustrate a fourth alternative embodiment in accordance with the present invention wherein the drive mechanism and rotating magnet described above are housed within a toy food item, such as corn-on-the-cob or a carrot. When the toy food item 970 containing a rotating magnet 980 is placed in the mouth of a doll or animal character containing a magnet 995 capable of movement within a flexible region of the mouth 990, the magnets alternately repel and attract each other creating the appearance that the doll is eating the food item.

Additional advantages and modifications will readily occur to those skilled in the art. Therefore, the invention in its broader aspects is not limited to the specific details and examples illustrated herein. Accordingly, various modifications may be made without departing from the spirit or scope of the general inventive concept as defined by the appended claims and their equivalents. For example, the housing of the toys could be shaped to resemble many different items and formed from a variety of flexible materials.

What is claimed is:

1. A toy figure comprising:

a face portion having at least one surface defining a mouth portion;

a magnet affixed to said face portion in close proximity to said mouth portion; and a bottle comprising a second magnet and a drive mechanism for generating movement of said second magnet relative to the bottle;

wherein said mouth portion moves in synchronization with motion imparted to said magnet through magnetic coupling with said second magnet.

2. The toy figure according to claim 1, wherein said drive mechanism includes an electric motor and reduction train.

3. A toy figure comprising:

a face portion having at least one surface defining a mouth portion;

a magnet affixed to said face portion in close proximity to said mouth portion; and a toy adult animal comprising a second magnet and a drive mechanism for generating movement of said second magnet relative to the toy adult animal;

wherein said mouth portion moves in synchronization with motion imparted to said magnet through magnetic coupling with said second magnet.

4. The toy figure according to claim 3, wherein said drive mechanism includes an electric motor and a reduction train.

5. A toy figure comprising:

a face portion having at least one surface defining a mouth portion;

a magnet affixed to said face portion in close proximity to said mouth portion; and an eating utensil comprising a second magnet and a drive mechanism for generating movement of said second magnet relative to the eating utensil;

wherein said mouth portion moves in synchronization with motion imparted to said magnet through magnetic coupling with said second magnet.

6. The toy figure according to claim 5, wherein said drive mechanism includes an electric motor and a reduction train.

7. A toy figure comprising:

a face portion having at least one surface defining a mouth portion;

a magnet affixed to said face portion in close proximity to said mouth portion; and a simulated food item comprising a second magnet and a drive mechanism for generating movement of said second magnet relative to the simulated food item;

wherein said mouth portion moves in synchronization with motion imparted to said magnet through magnetic coupling with said second magnet.

8. The toy figure according to claim 7, wherein said drive mechanism includes an electric motor and a reduction train.

* * * * *